US005660106A

United States Patent [19]

Pitz et al.

[11] Patent Number: 5,660,106

[45] Date of Patent: Aug. 26, 1997

[54] PRINTING UNIT HAVING A PLURALITY OF TYPE WHEELS ROTATABLE ON A COMMON SHAFT

[75] Inventors: Franz Pitz, Emmingen, Germany; Anders Berndtsson, Stein am Rhein, Switzerland

[73] Assignee: Atlantic Zeiser GmbH & Co., Emmingen, Germany

[21] Appl. No.: 572,804

[22] Filed: Dec. 15, 1995

[30] Foreign Application Priority Data

Dec. 23, 1994 [DE] Germany ..... 44 46 273.5

[51] Int. Cl.[6] ..... B41J 1/60

[52] U.S. Cl. ..... 101/99; 101/110

[58] Field of Search ..... 101/99, 106, 110, 101/91

[56] References Cited

U.S. PATENT DOCUMENTS

| | | | |
|---|---|---|---|
| 4,598,639 | 7/1986 | Sette | 101/110 |
| 4,608,923 | 9/1986 | Muller | 101/91 |
| 4,676,155 | 6/1987 | Harry et al. | 101/110 |
| 4,852,482 | 8/1989 | Storace | 101/110 |

FOREIGN PATENT DOCUMENTS

| | | |
|---|---|---|
| 0481185 | 4/1992 | European Pat. Off. . |
| 3047390 | 7/1982 | Germany . |

*Primary Examiner*—Christopher A. Bennett
*Attorney, Agent, or Firm*—Michael J. Striker

[57] ABSTRACT

A printing unit has a plurality of type wheels with types on its circumference which are rotatable on a common shaft and are driveable on it by means of a slip coupling. Each type wheel has an associated feeler device that ascertains its position and a pawl for engagement with the type wheel, with an actuator that is triggerable as a function of the feeler device via a control unit, and by the actuator the pawl can be controlled between a blocking position and a release position. The drive device serving the purpose of intermittently driving the shaft has per printing unit one drive shaft, operationally coupled to the shaft, with a driving gear wheel and one common stationary disc associated with a plurality of printing units disposed in the circumferential direction. On the pitch Circle of the respective driving gear wheel, this disc has a toothed segment associated with the gear wheel, with which segment the driving gear wheel can be brought into engagement upon revolution of the printing unit and hence for the length of the setting time.

59 Claims, 6 Drawing Sheets

PRINTING UNIT HAVING A PLURALITY OF TYPE WHEELS ROTATABLE ON A COMMON SHAFT

BACKGROUND OF THE INVENTION

The present invention relates generally to printing units.

More particularly, it relates to a printing unit which has a plurality of type wheels disposed on a common shaft, and a feeler device associated with each type wheel, as well as a pawl for engagement with the type wheel, having an actuator trigger by a control unit as a function of the feeler device so as to block or to release the type wheel.

Printing units of the above mentioned type are known in the art. One of such printing units is disclosed in German patent DE 30 47 970 C2. The printing unit disclosed in this reference has a relatively complicated, expensive drive device, slip coupling and feeler device.

SUMMARY OF THE INVENTION

Accordingly, it is an object of the present invention to provide a printing unit of the above mentioned general type, which has a simple, space-saving drive mechanism that makes high drive moments and speeds possible.

In keeping with these objects and with others which will become apparent hereinafter, one feature of the present invention resides, briefly stated, in a printing unit in which per printing unit, the drive device has one drive shaft, which is drivingly coupled with the shaft and which on one end carries a driving gear wheel, and also has one stationary disc which is associated with a plurality of revolving printing units disposed succeeding one another in the circumferential direction, which disc, on the pitch circle of the respective driving gear wheel, has a toothed segment associated with this gear wheel and having teeth on the outside or the inside, with which segment the respective driving gear wheel can be made to be in engagement upon revolution of the printing unit.

When the printing Unit is designed in accordance with the present invention the drive device of this kind makes high torques and speeds possible, and moreover the preconditions are created so that by means of the stationary disc of the drive device, a plurality of printing units, disposed one after the other in the circumferential direction and revolving, of a printing system can be driven. The drive device requires no separate motor. The drive device is simple in its mechanical design and it reduces the number of parts required for the drive considerably. Another advantage is that as a result the prerequisites for a compact design for each printing unit are created, so that as a result printing systems, such as impression cylinders, of up to 120 printing units can be formed, in which case the individual type wheels of each printing unit can then be triggerable individually and selectively and all the type wheels can be monitored, so that the advantage of a fully automatically settable printing unit can also be fully realized or preserved in this case.

The novel features -which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 5:
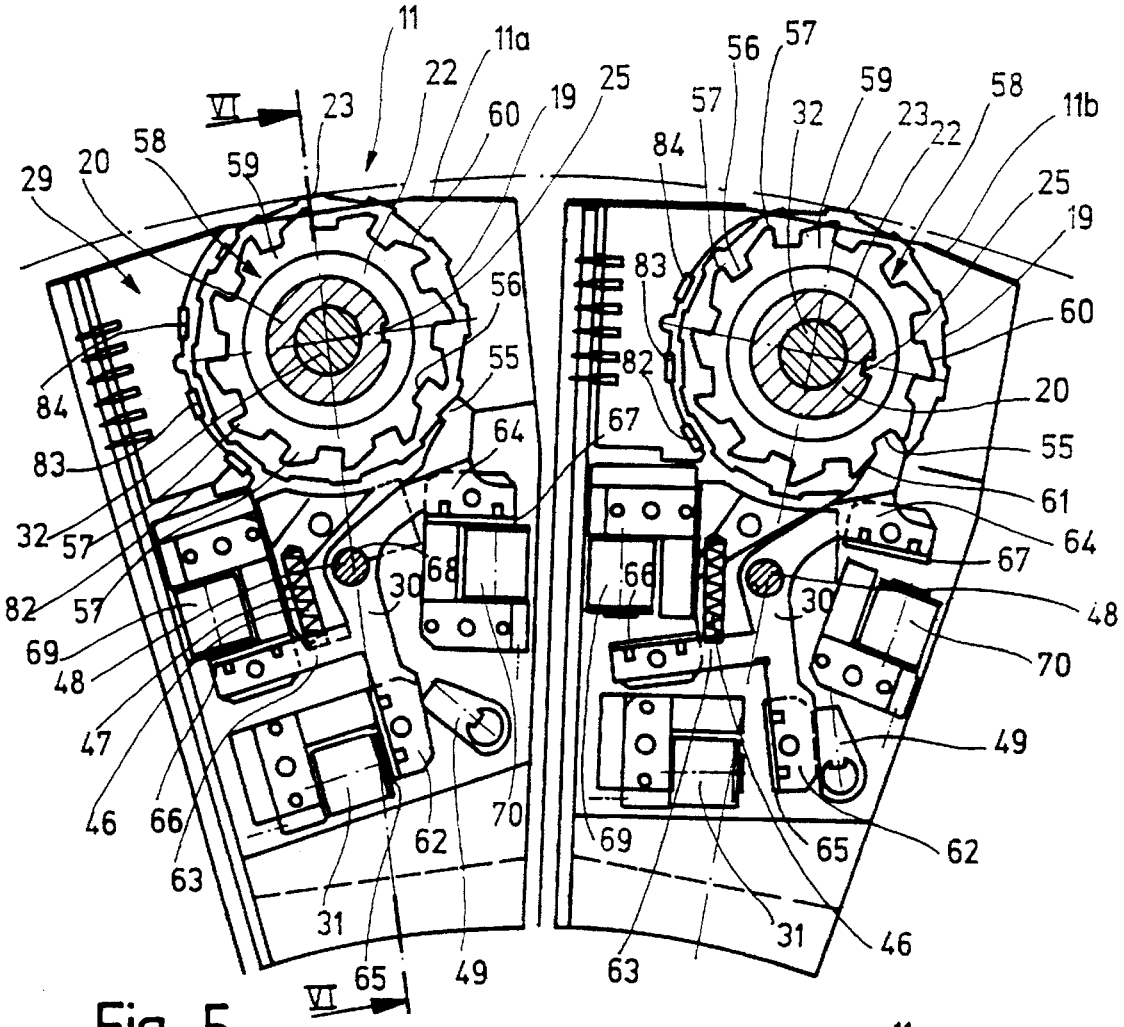
FIG. 5 is a schematic, partly sectional end view of two printing units of FIG. 1, on a larger scale, that follow one another in the circumferential direction.
Figure 6:
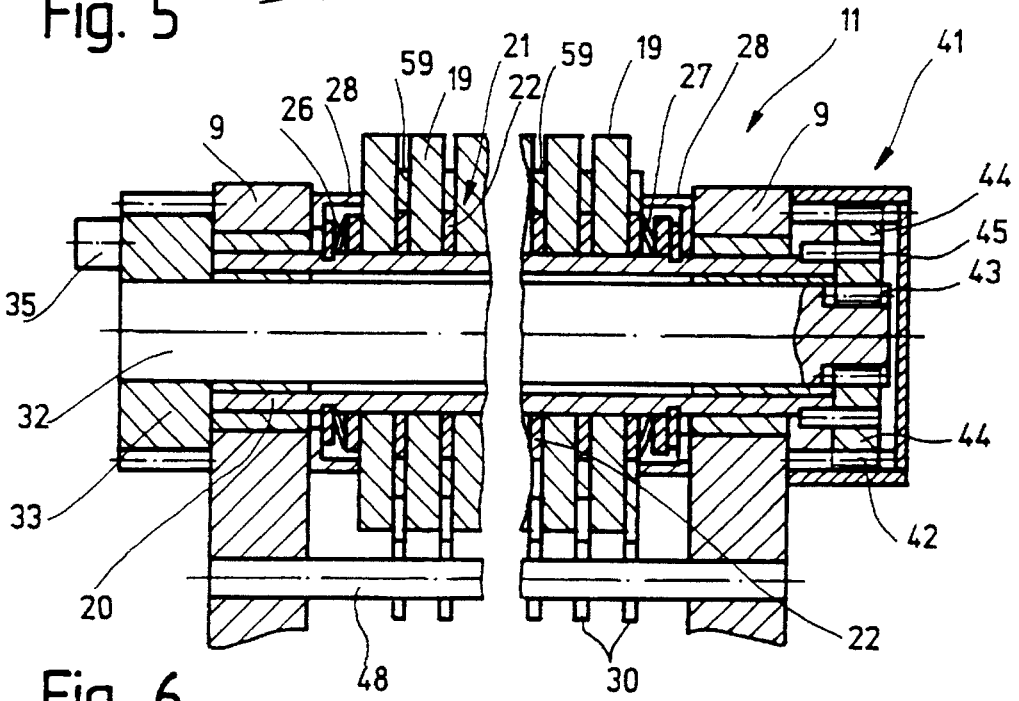
Figure 7:
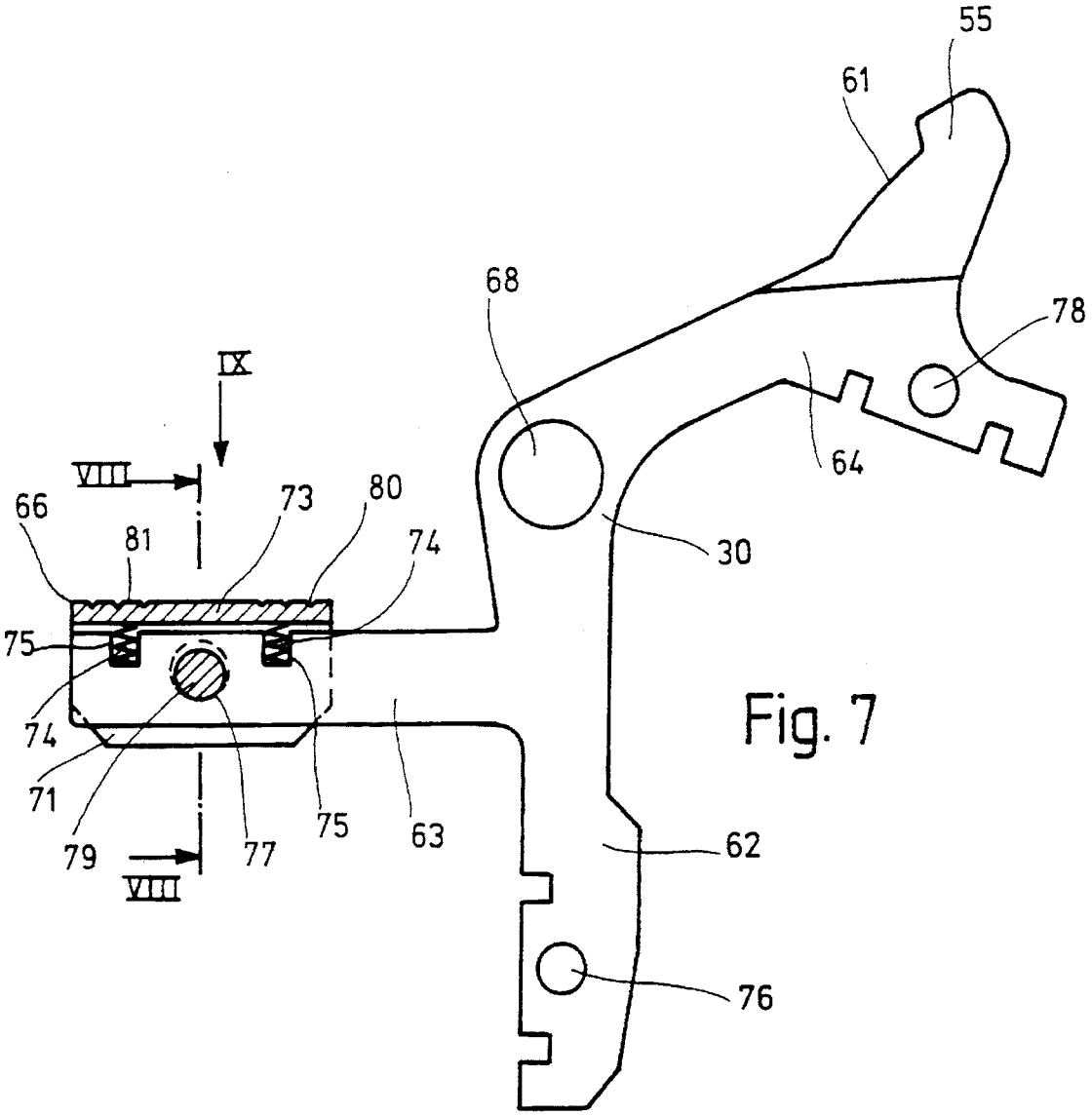
Figure 8:
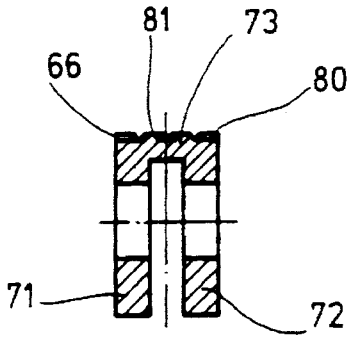
Figure 9:
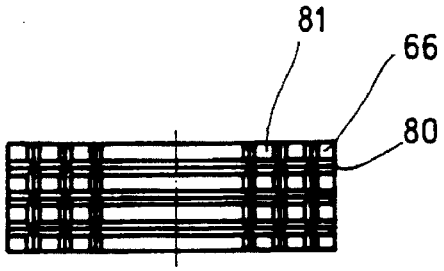

FIE. 6 is a schematic section along the line VI—VI of FIG. 5;

FIG. 7 is a partially sectional side view of a pawl associated with the type wheel of a printing unit;

FIG. 8 is a schematic section along the line VIII—VIII of FIG. 7;

FIG. 9 is a view in the direction of the arrow IX of FIG. 7; and

Figure 10:
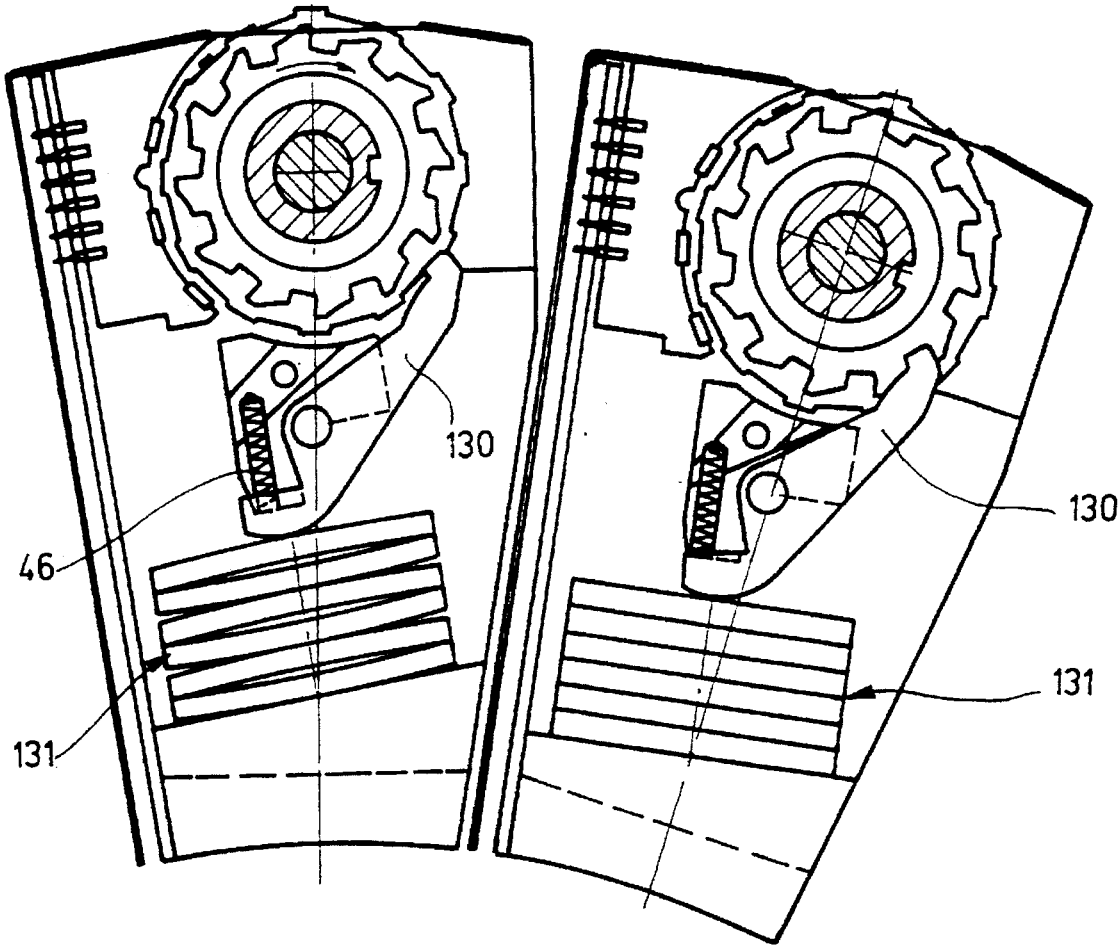

FIG. 10 is a schematic, partly sectional end view of two printing units, approximately corresponding to those of FIG. 5, in accordance with a second exemplary embodiment.

DESCRIPTION OF THE PREFERRED EMBODIMENTS

Figure 1:
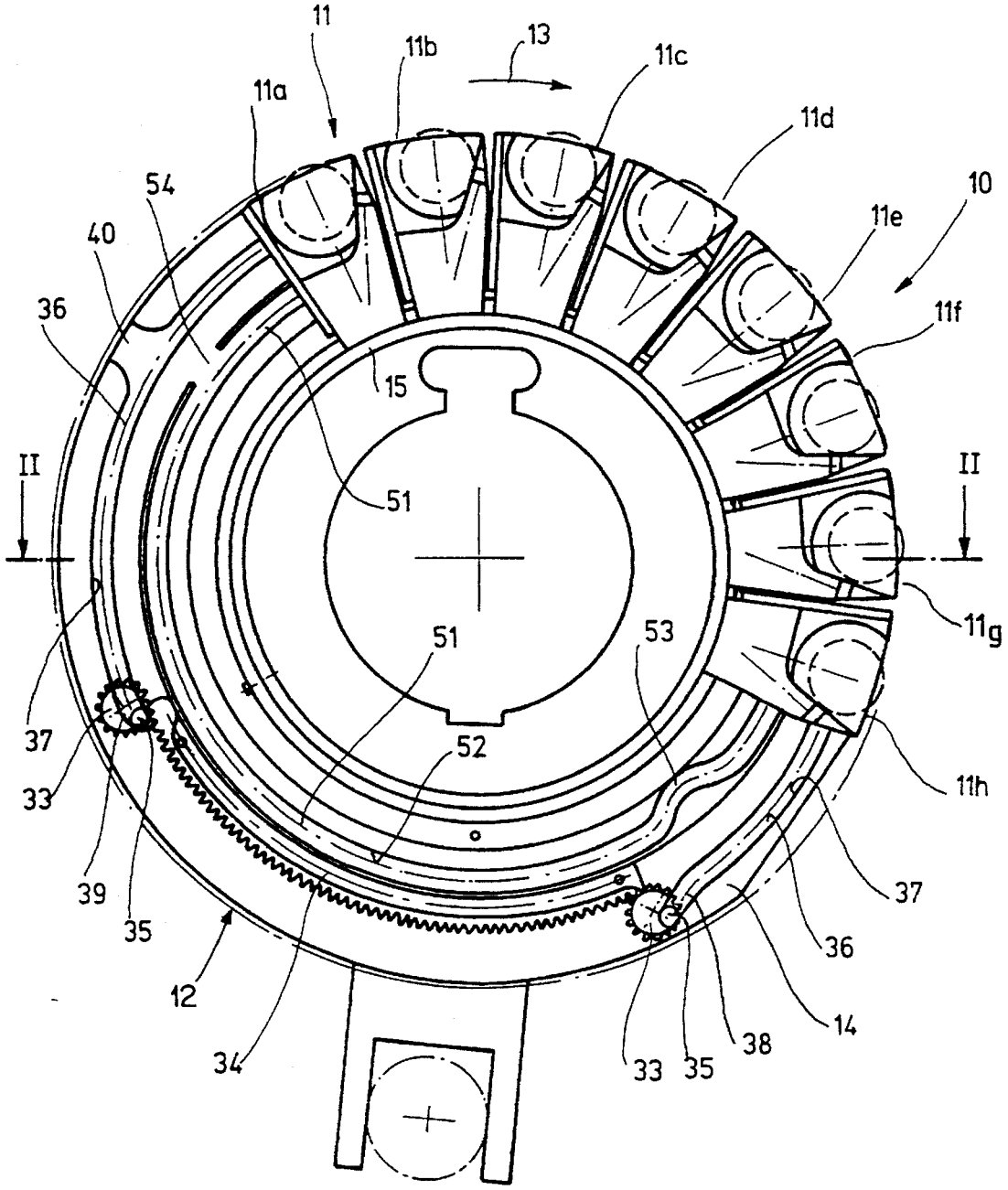
FIG. 1 is a schematic end view of a printing system having a plurality of identical printing units, disposed in the circumferential direction at intervals from one another, and an associated drive device.
Figure 2:
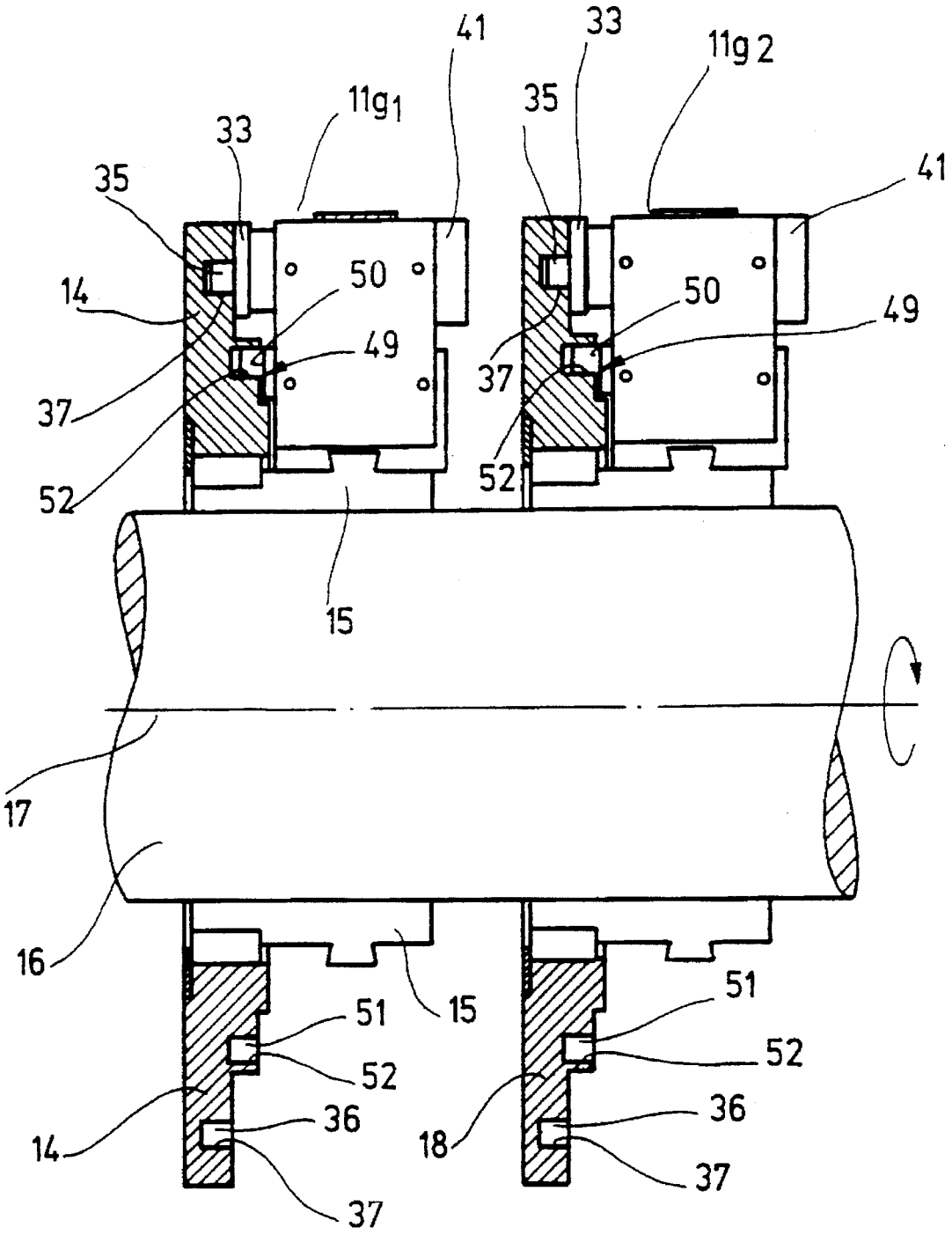
FIG. 2 is a schematic section along the line II—II of FIG. 1.

A printing system 10 in FIGS. 1 and 2 has a large number of individual, identically embodied printing units 11. In FIG. 1, eight printing units 11*a*, 11*b*, 11*c*, 11*d*, 11*e*, 11*f*, 11*g* and 11*h* disposed at intervals from one another on a carrier 12 in the circumferential direction can be seen in the printing system 10. These printing units all revolve together in the direction of the arrow 13, and as their drive mechanism, a stationary disc 14 common to all of them is associated with them. It is understood that instead of the eight printing units 11 shown, a larger number of them may be provided in the circumferential direction, such as 12 printing units or even up to 20 printing units. The carrier 12 of these printing units 11*a*–11*h*, which are disposed within a radial plane common to all of them n the circumferential direction, comprises by way of example a drum 15 shown only schematically. This carrier 12 and with it the printing units 11*a*–11*h* are disposed on a shaft 16 common to all of them and are driven by means of it to revolve in the direction of the arrow 13, relative to the disk 14 which is kept stationary.

As can be seen from FIG. 2, a number of identically designed printing units are again disposed one after the other on an imaginary axial line extending parallel to the axis 17 of revolution; these printing units in FIG. 2 are marked 11*g*1 and 11*g*2, and one disc 14 and 18, respectively, is assigned as a drive mechanism to each printing unit 11*g*1 and 11*g*2 on this imaginary axial line. If one follows the circumferential course of the disc 14, then the eight printing units 11*a*–11*h* (FIG. 1) by way of example are disposed along it. If one follows the circumferential course of the next disc 18, disposed at an axial distance from it on the shaft 16, then once again eight or more printing units, for example of the same type as the printing unit 11*g*2 are disposed along this circumferential course. Many individual identically embodied printing units 11 may be disposed at axial intervals from one another, in the direction of the axis of revolution 17, an example being 10 such printing units 11*g*1, 11*g*2, and those following them.

Figure 3:
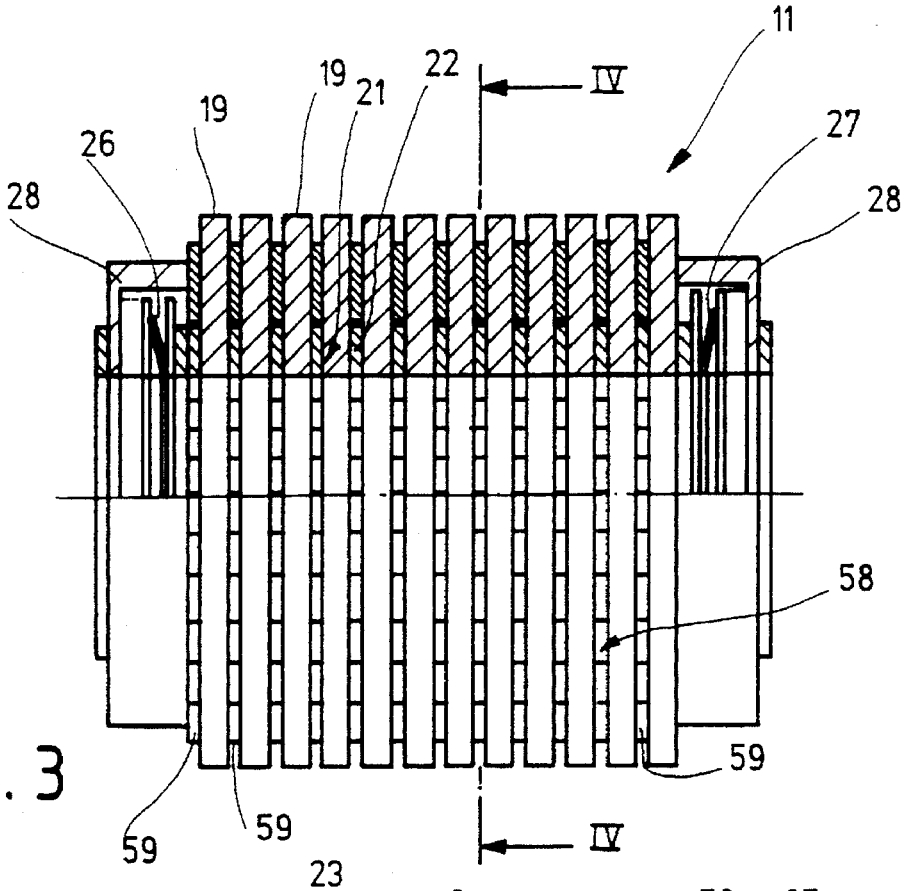
FIG. 3 Is a schematic, partially sectional side view of a wheel set of a single printing unit.

Details of a printing unit are provided below in conjunction with the drawings; all the printing units of the printing system 10, for instance as shown in FIGS. 1 and 2, are embodied entirely identically. Each printing unit 11 has a plurality of identically embodied type wheels 19, which are disposed rotatably and side by side on a common shaft 20 and are driveable by this shaft via a respective slip coupling 21 in the form of a friction disc 22. Types 23, in the form of numbers, letters, symbols or the like are placed over the circumferential surface of each type wheel 19, suitably in raised form, as shown. This is shown especially clearly in FIG. 4. From it can be seen that each type wheel 19 has a total of 12 types 23 on its circumference, at equal circumferential angle intervals from one another; ten types 23 are embodied as numbers from 0 to 9; one type 23 is embodied as a letter; and the twelfth type is embodied by a space that makes the "do not print" setting possible. The letter types and the space are disposed between the number types 1 and 0. Each friction wheel 22 is positively coupled to the shaft 20. This is done by means of a radial driver 24, for instance a dog, of the friction disc 22, that positively engages a groove 25 of the shaft 20. Each friction disc 22 comprises metal, in particular steel, coated with plastic, such as Teflon, thus assuring great durability and a frictional moment that always remains constant. The friction discs 22 are pressed via axial pressure against the respective type wheel 19. For instance, the wheel set, shown as a unit in FIG. 3 and comprising the type wheels 19 and friction discs 22 placed between them, is placed on the shaft 20. The axial pressure that compresses the wheel set is attained by spring discs 26 and 27 on both sides, which are placed between respective discs, the outer one of which may be a securing ring that is retained in an annular groove of the, shaft 20. The wheel set is prestressed by the spring discs 26, 27. It can be closed off on the outside by means of caps 28 as needed.

The type wheels 29 are rotated virtually synchronously with the shaft 20 Upon its revolution as a result of the frictional engagement thus created.

Each type wheel 19 s assigned a feeler device 29 that ascertains its position and a pawl 30 for engagement with the type wheel 19. Details of the pawl 30 and of its blocking function will be described in further detail hereinafter. Each pawl 30 is assigned an actuator 31, which is triggerable via a control unit, not shown in further detail, as a function of the feeler device 29. Thus actuator 31, in the first exemplary embodiment of FIGS. 1–9, which in a special form serves as a holding magnet. In the second exemplary embodiment in FIG. 10, the actuator 31 instead comprises a piezoelectric adjusting element 131, and the pawl 130 is embodied differently from the first exemplary embodiment. Otherwise, the second exemplary embodiment of FIG. 10 is equivalent to the first exemplary embodiment of FIGS. 1–9, however.

Each pawl 30 per type wheel 19 is controllable by means of its associated actuator 31, for instance a holding magnet, between a blocking position that blocks the type wheel 19, as shown on the right in FIG. 5, and a release position that releases the type wheel 19, as shown on the left in FIG. 5, for example.

A drive device for intermittently driving the shaft 20 and thus the wheel set on it is also provided, and this drive does not take place constantly but rather only for a certain setting time within which fully automatic setting of the printing unit 11 takes place.

The stationary disc 14 already described in conjunction with FIGS. 1 and 2, which is associated with the individual printing units 11*a*–11*h* (FIG. 1) dispose din succession in the circumferential direction, is one part of this drive device, along with the next stationary disc 18, placed at an axial distance from it, which is associated with the printing unit 11*g*2 and further printing units following it in the circumferential direction. The discs 14, 18 and so on are each identical; and it will suffice to provide further details below solely for the disc 14. Per printing unit 11, the drive device also includes a drive shaft 32, operationally coupled to its shaft 20, which has a driving gear wheel 33 on one end. Associated with the respective driving gear wheel 33 per printing unit 11*a*–11*h*, in the region of the disc 14, is a toothed segment 34 with teeth on its outside located on the pitch circle of the driving gear wheel 33; the respective driving gear wheel 33 can be brought into engagement with this toothed segment upon revolution of the printing unit 11*a*–11*h*. As particularly seen in FIG. 1, the toothed segment 34 extends over a circumferential angle less than 160°, for instance, such as an angle in the range from about 80° to 110°. Only for the period of time while driving gear wheel 33 is in engagement with the toothed segment 34 does its drive thus occur upon revolution of the printing unit. This time is available as a setting time for the individual type wheels 19 of each wheel set.

The driving gear wheel 33 ha a protrusion 35 eccentric to it, which plays a role not illustrated in detail here. The disc 14, 18 has a path 36, for instance in the form of a groove 37, which precedes the beginning of the toothed segment 34 in the direction of revolution indicated by the arrow 13 and cooperates with the eccentric protrusion 35; this groove is embodied as a cam race and it produces a drive of the drive shaft 32 in the same direction of rotation, preferable an acceleration, that chronologically precedes the engagement of the driving gear wheel 33 with the toothed segment 34. Moreover, this assures a defined tooth engagement of the driving gear wheel 33 with the toothed segment 34. By means of the eccentric protrusion 35 and the path 36, in particular the grove 37, a gentle acceleration of the drive shaft 32 and hence of the entire wheel set driven by it is attained. As a result of this acceleration upon drive of the wheel set, jerking, shocks and similar abrupt loads at the onset of the toothed engagement, which cause damage and severe wear, are precluded or at least reduced considerably. A gentle startup of driving with as little jerking as possible is attained.

The path 36 for instance the groove 37, extends over a circumferential angle that by way of example is greater than 200° and in particular is in the range from about 250° to 280°. This circumferential angle of the path 36 is matched to that of the toothed segment 34. The path 36, for instance the groove 37, adjoins the toothed segment 34 at both ends; at the beginning of the toothed segment 34, in the region of the path 36, for instance the groove 37, preceding it in the direction of revolution, a radially Outward-extending terminal portion.. 38 is provided. The path 36, for instance the groove 37, extends substantially along the pitch circle of the driving gear wheel 33 or toothed segment 34; at the end of the path 36, the outward-extending terminal portion 38 begins at that task. This terminal portion 38 causes the aforementioned acceleration of the drive shaft 32 and thus acts as an acceleration portion.

At the beginning of the path 36, for instance the groove 37, a radial initial portion 39 is provided, which changes at least slightly radially from the inside outward over into the path 36, and thus assures a good entry of the protrusion 35 into the path 36 once the driving gear wheel 33, at the end of the toothed segment 34, comes out of engagement with the toothed segment. Over its circumferential course, the path 36, in particular the groove 37, includes a radially outwardly open inlet slit 40 for the insertion of the eccentric protrusion 35 into the groove 37.

The drive of the wheel set, in particular the drive of the shaft 20, is effected from the drive shaft 32 via a speed-change gear 41, which brings about a speed reduction, for instance. The speed-change gear 41 in particular comprises a planetary gear. The drive shaft 32 is operationally coupled with the shaft 20 to be driven by way of the speed-change gear 41. The shaft 20 is embodied as a hollow shaft. As a result, the drive shaft 32 can extend inside the hollow shaft 20, coaxially with it. This saves space. The speed-change gear 41, in particular a planetary gear, is disposed on one end of the drive shaft 32, on the end opposite the end carrying the driving gear wheel 33. The planetary gear has an internal geared wheel 42 retained in a manner fixed against relative rotation on the printing unit 11, for instance on its housing 9, and as its sun wheel it has a driving pinion 43, joined to the drive shaft 32 in a manner fixed against relative rotation, with which the planet wheels 44 mesh, which in turn are rotatably supported on the shaft 20, for instance by means of bearing bolts 45 suggested in the drawing. The speed-change gear 41 and the overall drive for the shaft 20 can be designed such that this gear is rotated over a circumferential angle of more than 360°, so that the highest possible machine rpm can be attained. The drive 20 and the drive shaft 32 can be supported by means of slide bearings. The housing 9 may be in split form, which makes removal of the complete wheel set in the axial direction easy. The arrangement may be chosen such that the drive shaft 32 can be pulled out of the speed change gear 41 to the left in FIG. 6. This is accomplished by providing the driving pinion 43 with a smaller diameter than the drive shaft 32. Upon the removal, the speed-change gear 41 can continue to be connected to the right-hand wall, as soon as FIG. 6, of the housing 9 even after removal of the wheel set.

The circumferential angle length of the toothed segment 34 is dimensioned such that the type wheels 19 of each printing unit 11 are driven only for a predetermined setting time, in which the shaft 20 as already noted is rotated by more than 360°.

Another, also essential special feature of the printing unit 11 is that by means of the respective actuator 31, each pawl 30 can be kept in its released position (FIG. 5, left) and out of engagement with the type wheel 19. To that end, the respectively associated actuator 31, in particular an electromagnet, may be activated and in particular turned on, so that the pawl 30 is held in this release position by means of the actuator 31. The actuator 31 is also controllable into a position that releases the pawl 30, in which case the released pawl can be forced into its blocking position by means of the force of a spring 46 acting upon it; the blocking position is shown in the right in FIG. 5. In this made of operation, the actuators 31, in particular electromagnets, are used as holding magnets. In this release position of the respective pawl 30, they make strong holding forces possible. The respective spring 46 is received in a receptacle 47 of the housing 9 and supported by its end located at the bottom in FIG. 5 on the pawl 30. The prestressing of the spring 46 can be adjustable. The spring 46 is embodied as a compression spring. Because the respective actuator 31, in particular the electromagnet, now serves only as a holding magnet, and each pawl 30 can be forced into its blocking position (FIG. 5, right) by means of the spring 46, each type wheel 19 in the currentless state is blocked by means of the pawl 30. The embodiment makes it possible to use strong springs 46. As a result, major forces can be brought to bear to shift each pawl 30 into the blocking position. Any possible jamming, caused by soiling, for instance, can be averted by means of suitably strong spring forces. Thus a reliable motion of the pawls 30 into their blocking position by means of the respective spring 46 can be assured. The actuator 31, in particular the electromagnet, makes a strong magnetic holding force possible. The release position of the pawl 30 is thus reliably assured not only when there is a smaller air gap but also when there is a large air gap in the region of the electromagnet. It is possible upon activation of the actuator 31, in particular of the electromagnet, to pull the respective pawl 30 all the way against the stop.

All the pawls 30 of each individual printing unit 11 are pivotably supported on a common shaft 48. At a radial distance from the shaft 48, a lifter device 49 common to all the pawls 30 of the respective printing unit 11 is provided, by means of which all the pawls 30 can be lifted jointly in the period that is outside the setting time of the type wheels 19 and put into an outset position. The lifter device 49 has one eccentric protrusion 50 per printing unit on the end of a lifter shaft, not shown in further detail, that is common to all the pawls 30. The stationary disc 14 has an approximately circular cam race 51, such as a groove 52, that is associated with a plurality of revolving printing units **11*a*–11*h* disposed in succession in the circumferential direction; upon revolution, the protrusion 50 constantly in engagement with this cam race or groove. In the same way, the next disc 18 (FIG. 2) spaced apart from the disc 14 is provided with a corresponding cam race 51, in particular groove 52**.

This cam race 51, in particular groove 52, has a curved portion 53 that departs from the circular on the circumferential region preceding the beginning of the setting time of the type wheels 19. The curved portion 53 together with the eccentric protrusion 50 controls a lifting motion of the pawls 30 of the respective printing unit 11. The electric protrusion 50 comprises a roller, for instance. The cam race 51, in particular groove 52, has a radially outwardly open inlet 54 for insertion of the protrusion 50, in particular the roller, into the cam race 51.

The drive of both the type wheels 19 and the lifter device 49 for the pawls 30 is effected with the aid of the stationary, two-path disc 14 with the toothed segment 34, specifically for all the printing units **11*a*–11*h* placed at intervals from one another in the circumferential direction within a common radial plane. Such a drive device is not only simple and economical but also space-saving and has the advantage above all of not requiring any drive motor and that with it high torque and speeds can be attained; a drive of up to 20 printing units 11*a*–11*h***, for instance, with these advantages is attainable. Because high torque and high speeds are attainable, greater safety is obtained, since work can be done with stronger forces. These stronger forces are thus brought to bear in a simple and space-saving way by this drive device. High speeds of up to 10,000 rpm are attainable.

Each pawl 30 has, at a radial distance from the bearing on the shaft 48, a blocking tooth 55 for engagement with an identically shaped tooth gap 56 between two successive teeth 57 of a blocking device 58 of the respective type wheel 19, for instance a blocking disc 59 solid with it; each blocking tooth 55 is embodied for blockage in both directions of rotation of the type wheel 19. There is accordingly virtually no play between a tooth gap 56 and the blocking tooth 55 of the pawl 30 engaging that gap. Hence it is possible to lock the respective type wheel 19 in both directions of rotation. Any recoil of the type wheel 19 as it stips is thus likewise prevented.

Figure 4:
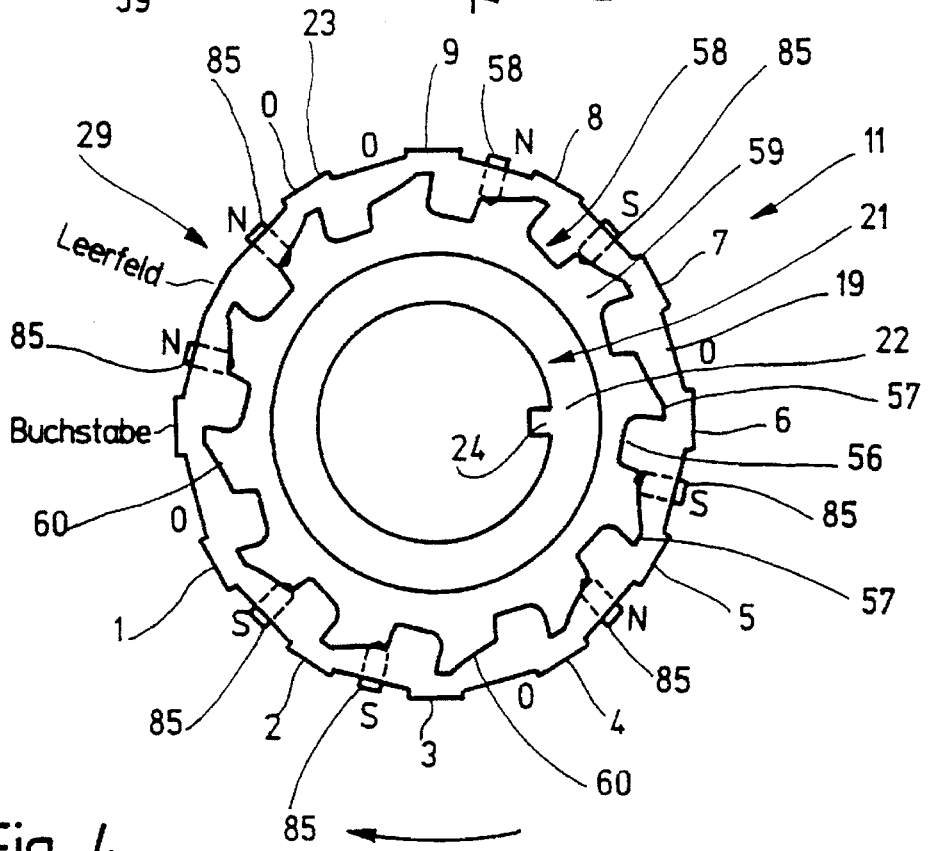
FIG. 4 is a schematic side view in the direction of the arrow IV—IV of FIG. 3.

The teeth 57 of the blocking device 58, in particular the blocking disc 59 are embodied in side view approximately like the teeth of a circular saw blade, which an best be seen from FIG. 4. The tooth gaps 56 are approximately U-shaped, but the middle line of the U does not extend in the direction of a radial but rather in the direction of a secant, with respect to the center axis of each type wheel 19 and each blocking disc 59. A further special feature is that the respective tooth 57 that precedes the tooth gap 56 in the circumferential direction has a tooth back 60 that drops off obliquely toward the tooth gap 56. In a corresponding relationship, the blocking tooth 55 of each pawl 30 has a portion that engages the U-shaped tooth gap 56 and on this side has an oblique edge 61, beginning at the base of this portion, which can come to rest on the oblique tooth gap 60, as shown on the right in FIG. 5. The blocking device 58, in particular the blocking disc 59, is a fixed component of the type wheel 19, for instance either being integral with it or being joined as a separate disc solidly to the type wheel 19, for instance by soldering.

Each pawl 30 is a flat, one-piece structure. It has a total of three arms 62, 63 and 64 protruding at a radial distance from the shaft 48. The arms 62 and 63 are oriented approximately at right angles to one another; the arm 63 begins approximately at a right angle from a substantially rectilinear leg that carries the arm 62 in extension. The third arm 64 extends on the right-hand side of the arm 62, in terms of FIG. 7, and thus above the bearing boe 68 with which the pawl 30 is rotatably supported on the shaft 48. The third arm 64 extends at an angle smaller than 90° from the first arm 62.

Each arm 62, 63 and 64 is embodied identically for retaining an associated armature 65, 66 and 67, which together with the actuator 31, in particular the electromagnet, serves to control the pawl 30. One actuator 31, 69 and 70, in particular an electromagnet, is associated with each arm 62–64 with the armature 65–67, the actuators being grouped annularly around the shaft 48 and succeeding one another at intervals in the direction of the shaft 48. Thus for each printing unit 11, viewed in the direction along the shaft 20 with the individual type wheels 19 and pawls 30 associated with them, a first pawl 30 is provided hat on its first arm 62 carries a first armature 65, with which a first actuator 31 is associated for purposes of actuation. Next in the axial direction is a second pawl, which on its second arm 63 carries an armature 66; a second actuator 69, especially an electromagnet, is associated with this second arm 63 and armature 66. Next follows a third pawl 30, which on its third arm 64 carries a third armature 67, with which a third actuator 70, in particular an electromagnet, is associated. Next is once again a first pawl 30, which on its first arm 62 carries a first armature 65, with which a first actuator 31, in particular an electromagnet, is associated. This is followed by a second pawl 30, which on its second arm 63 carries a second armature 66, with which a second actuator 69 in particular an electromagnet, is associated. This order then continues along the shaft 48.

For each pawl 30, the receptacle and retaining means, provided on the first arm 62, second arm 63 and third arm 64, respectively for the first armature 65, second armature 66 and third armature 67, is embodied identically. Details of this will be described in conjunction with FIGS. 7–9 taking as an example the second arm 63 and the second armature 66 mounted on it. The respective armature 66 is retained resiliently, at least spring-mounted, on the respective arm 63 of the pawl 30. Each armature 66 is approximately U-shaped, and the two legs 71, 72 of the U laterally fit over the respective arm 63 of the pawl 30, specifically on the outside of each arm. The cross bar 73 forming the base of the U and joining the two legs 71, 72 covers the narrow face toward it of the arm 63, on which the cross bar 73 is resiliently supported by means of two spaced-apart springs 74 which are received in associated indentations 75 of the arm 63. Each arm 62–64 includes an opening 76, 77 and 78, respectively, such as a bore, which for securing of the respective armature 65, 66 and 67 is penetrated by the retaining bolt 79, which with radial play passes through the associated armature 66, especially the two legs 71, 72 of the U thereof, so that inward spring deflection of the armature 66 relative to the arm 63 counter to the action of the springs 74 is possible.

Each armature 65–67, as shown for the second armature 66 in FIGS. 7–9, thus ha surface indentations 80 and/or surface protuberances 81, in particular longitudinal channels and/or crosswise channels, for instance, on the outer face, toward the respective electromagnet, of its cross bar 73. As a result, any sticking to the electromagnet is avoided, even if the surface of the cross bar 73 should be dirty.

In adaptation to the fact that each type wheel 19 carries twelve types 23 per printing unit 11, the blocking device 58, in particular the blocking disc 59, associated with each type wheel 19 is also provided with twelve teeth 57, succeeding one another at the same circumferential angle intervals.

For each printing unit 11, one feeler device 29 is associated with each individual type wheel 19. Each feeler device 29 has oer type wheel 19 three Hall sensors 82, 83 and 84, disposed at intervals from one another along the path of revolution of the type wheel 19. The feeler device 29 also includes a hybrid circuit, not shown in further detail, with a suitable chip. Electrical cables lead from the feeler device 29 to a central control unit, not shown further here. Further components of the feeler device 29, besides the Hall sensors 82, 83 and 84, are individual permanent magnets 85 of differing polarity, which are placed along the circumference of each type wheel 19. The permanent magnets 85 are each disposed between two type 23 on the circumferential region, but not every intermediate region between two types 23 has permanent magnets 85. For coding the types 23 of each type wheel 19, the permanent magnets 85 may for instance be grouped in other order S S O N S O S N O N N O, as is the case in FIG. 3. Here N equals north pole, O equals no permanent magnet and S equals south pole. Some-other order is also possible instead. In any case the arrangement is such that each type 23 of a type wheel 19 is identified by the signals of two permanent magnets 85, or in other words when precisely two magnet signals, for instance one N and one S, are applied then unequivocally one type 23 is reached and the type 23 in question is thus unequivocally identified. Only one magnet signals means that the type 23 has not yet been reached. Upon the second magnet signal the type 23 is immediately unequivocally identified. There are not combinations of three signals.

The described embodiment of the feeler device 29 with three Hall sensors 82–84 for direct scanning of the respective type wheel 19 as the advantage of fast, reliable detection of even small dimensions. Since each type wheel 19 is in a total of twelve parts, or in other words can carry twelve types 23, with the respective coding discussed above, or in other words with the respective association of permanent magnets 85, the advantage is attained that all the types 23 can be identified unequivocally and quickly by means of two magnet signals. Ten types 23 are needed for the numbers from 0 to 9. A cancellation mark, letter or the like is possible as the eleventh type 23, so that when the respective type wheel 19 is set up, a cancellation mark can be imprinted on this eleventh type 23. Until now, cancellation required separate, controlled cancellation mechanisms in an additional printing station of the printing system 10. Now the cancellation mark can be printed by means of the respective printing unit 11 by suitable setting of the respective type wheel 19. A space can be provided as the twelfth type 23. This makes it simple to shut off printing by a printing unit 11. All the printing units 11 of the printing system 10 can thus be switched for printing shutoff by suitable setting of the respective type wheels 19, so that this function either need not be present in the printing press, or need not be separately controlled. The fully automatically settable respective printing unit 11 further has the advantage that selectively arbitrary, even non-sequential numbers can be set. Therefore it is unnecessary to have mechanically different mechanisms for different applications. Manually presetting the printing unit 11 to the intended starting number at the beginning of a printing job, which otherwise required up to 1500 types wheels which were moreover poorly accessible in the printing press, is no longer necessary, either. The "pre-ink" function can be controlled by software. No manual switchover is necessary, not even any switchover via indexing cam actuation of a light. Cleaning of the individual printing units at the end of a shaft is made substantially easier and can be done more thoroughly. Another advantage is the simple mechanical layout. Because of the omission of some unnecessary parts that are typical in numbering mechanisms and are complicated, such as cranks, front grippers, preinking cones, pregripper controls, and so forth, the mechanical layout is considerably simplified. Another advantage is that a high setting speed is attainable per printing unit for setting the type wheels 19. The setting can be done in a period of 100 μs, calculated from printing through to inking. Even faster setting times are possible. In all cases reliable detection of the respective types 34 of each type wheel 19 is assured. Another advantage is the very small structural size. As a result, printing systems, such as numbering cylinders, with up to 120 numbering mechanisms with twelve type wheels 19 each can be provided, all the type wheels 19 can be triggered and monitored selectively. Printing speeds of up to 18,000 rmp are possible.

Each printing unit 11 is driven during the setting time available, specifically whenever upon revolution of the driving gear wheel 13 the stationary disc 14 enters into engagement with the toothed segment 34. Beforehand, via the curved portion 53 and the eccentric protrusion 50 of the lifter device 49, a simultaneous lifting of all the pawls 30 has been accomplished, counter to the action of the respective spring 46. Next, all the actuators 31, 69, 70 and so forth have been actuated by the control unit and moreover the various pawls 30 have been put in the release position, in which they are held electromagnetically by the cooperation of the various electromagnets with the armatures of the pawls. At this stage, the individual type wheels 19 are freely driveable. Via the driven drive shaft 32, the speed-change gear 41 and the shaft 20 and the respective slip-coupling 21, in particular the friction-discs 22, the individual type wheels 19 are rotated. Stopping of the individual type wheels 19 is done by turning off the power supply to each individual actuator 31, 69, 70 at the predetermined time, and whenever the feeler device 29 has ascertained that the particular desired, predetermined type 23 of the respective type wheel 19 has assumed the printing position. Cutting off the power supply to the particular actuator 31, 69, 70 then causes a release of the pawl 30, which is then transferred to its blocking position (FIG. 5, right) by means of the spring 46 as it decompresses; in the blocking position, the type wheel 19 is positively prevented from further rotation via the blocking tooth 55 that engages the toothed gap 56. The moment or time for the shutoff current pulse is defined by the control unit as a function of the types 23 to be set, and it is enabled upon reaching the fixed type 23, which are coded by the permanent magnets 85 let into the type wheels 19 and are monitored by the Hall sensors 82, 83 and 84. The printing process then takes place. Once imprinting has been done and before the next setting operation, all the pawls 30 are returned to the aforementioned outset position by the lifter device 49, and they remain in that position until the actuators 31, 69, 70 are turned on.

The second exemplary embodiment shown in FIG. 2 functions in the same way. For setting of the type wheels, the shaft 20 is again rotated via the drive shaft 32 by more than 360° during the setting time. The type wheels are prevented from rotating with the shaft 20 by means of pawls 130, which are forced into their blocking position by the spring 46. Before the individual type wheels are set, the pawls 130 are pt into the release position by the activation of the various actuators 131, in the form of piezoelectric elements, by the application of a voltage. Once the desired type 23 per type wheel 19 is reached in the course of the automatic setting, the supply of power to the actuator 131 is interrupted, so that the respective spring 46 can transfer the pawl 130 to its blocking position.

It will be understood that each of the elements described above, or two or more together, may also find a useful application in other types of constructions differing from the types described above.

While the invention has been illustrated and described as embodied in a printing unit, it is not intended to be limited to the details shown, since various modifications and structural changes may be made without departing in any way from the spirit of the present invention.

Without further analysis, the foregoing will so fully reveal the gist Of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A printing system including a plurality of printing units, each having a plurality of type wheels arranged rotatably side by side on a common shaft and driveable by said shaft via a slip coupling, said type wheels having circumferential faces provides with wheel types; a filler device associated with each of said type wheels and ascertaining a position of each of said type wheels; a pawl provided for engagement with said type wheel; a control unit connected with said filler device; an actuator triggerable by said control unit as a function of said filler device and controlling said pawl between a blocking position in which said pawl blocks said type wheel and a clearing position in which said pawl releases said type wheel; a drive device for intermittent driving of said shaft, said drive device having one drive shaft which is drivingly coupled with said common shaft and has one end carrying a driving gear wheel having a pitch circle; a stationary disc associated with said plurality of printing units located one after the other in a circumferential direction, said disc on said pitch circle of said driving gear wheel having a toothed segment associated with said driving gear wheel and having teeth on at least one of an outside and an inside, said driving gear wheel being engageable with said segment upon revolution of the printing unit.

2. A printing system as defined in claim 1, wherein said driving gear wheel has an eccentric protrusion, said disc having a path which precedes a beginning of said toothed segment in a circumferential direction and cooperates with said eccentric protrusion and which generates a drive of said drive shaft in the same direction of rotation which chronologically precedes the engagement of said driving gear wheel with said toothed segment.

3. A printing system as defined in claim 1, wherein said path of said disc generates an acceleration of said drive shaft.

4. A printing system as defined in claim 1, wherein said path of Said disc is formed as a cam race.

5. A printing system as defined in claim 1, wherein said path of said disc is formed as a groove provided in said disc.

6. A printing system as defined in claim 1, wherein said path extends over a circumferential angle greater than 200°.

7. A printing system as defined in claim 6, wherein said path extends substantially over a range from 250° to 280° of a circumferential angle.

8. A printing system as defined in claim 1, wherein said toothed segment extends over a circumferential angle of less than 160°.

9. A printing system as defined in claim 8, wherein said toothed segment extends over a circumferential angle range from 80° to 110°.

10. A printing system as defined in claim 1, wherein said path adjoins said toothed segment at both ends of said toothed segment, said path having a region preceding the beginning of said toothed segment in a circumferential direction and in said region being provided with radially outwardly extending final portion of said path.

11. A printing system as defined in claim 10, wherein said path is formed as a groove extending substantially along a pitch circle of said driving gear wheel, said radially outwardly extending final portion beginning at an end of said path.

12. A printing system as defined in claim 2, wherein said path is formed as a groove having a beginning at which a radial initial portion is provided, said radial initial portion changing radially from inside outward over into said path.

13. A printing system as defined in claim 2, wherein said path on its circumferential course has an inlet slit which radially opens toward an outside, for insertion of said eccentric protrusion.

14. A printing system as defined in claim 2, wherein said eccentric protrusion is provided with a roller.

15. A printing system as defined in claim 1; and further comprising a speed change gear arranged so that said drive shaft is coupled to said common shaft by said speed-change gear.

16. A printing system as defined in claim 1, wherein said common shaft is formed as a hollow shaft, said drive shaft extending inside said hollow shaft coaxially with said hollow shaft.

17. A printing system as defined in claim 1, wherein said common shaft is a hollow shaft; and further comprising a planetary gear arranged so that said drive shaft is coupled to said hollow shaft by said planetary gear.

18. A printing system as defined in claim 1, wherein said drive shaft has an end which carries said driving gear wheel and an opposite end, said drive shaft being provided at said opposite end with a speed-change gear formed as a planetary gear.

19. A printing system as defined in claim 18; and further comprising a printing system housing, said planetary gear having an internal geared wheel retained on said printing system housing so as to be fixed against relative rotation, a sun wheel having a drive pinion connected to said drive shaft in a manner fixed against relative rotation, and planet wheels engaging with said internal geared wheel and said drive pinion, said planet wheels being rotatably supported on said common shaft.

20. A printing system as defined in claim 1, wherein said toothed segment of said disc has a circumferential angle length dimensioned such that said type wheels are driven only for a predetermined setting time.

21. A printing system as defined in claim 1; and further comprising a spring acting upon said pawl; and an actuator holding each pawl in its release position and out of engagement with said type wheel, said actuator being controllable into a position that releases said pawl, and said pawl in released condition being forcible into its blocking position by a force of said spring.

22. A printing system as defined in claim 21, wherein said actuator is formed as an electromagnet, said electromagnet acting as a holding magnet.

23. A printing system as defined in claim 21, wherein said actuator is formed as an electromagnet, said electromagnet being formed as a holding magnet.

24. A printing system as defined in claim 21, wherein said actuator is formed as a piezoelectric adjusting element.

25. A printing system as defined in claim 1; and further comprising a common pawl shaft, said pawls being pivotally supported on said common pawl shaft; and a lifting device which is common to said pawls and arranged at a radial spacing from said common pawl shaft so as to lift all said pawls during a period located outside the setting time of said type wheels and bringable into an outset position.

26. A printing system as defined in claim 25, wherein said lifter device has an eccentric protrusion on one end of a lifter shaft which is common to all said pawls, said stationary disc having a substantially cam race associated with a plurality of revolving printing units located successively one after the other in a circumferential direction, said race being continuously engaged with an eccentric protrusion upon revolution and having a curved portion on a circumferential region, deviating from a circular form and preceding a beginning of a setting time of said type wheels, said curved portion together with said eccentric protrusion controlling a lifting motion of all said pawls.

27. A printing system as defined in claim 26, wherein said eccentric protrusion is provided with a roller.

28. A printing system as defined in claim 26, wherein said cam race is formed as a groove in said disc.

29. A printing system as defined in claim 26, wherein said cam race is formed as a groove having an inlet which is open radially outwardly for introduction of said eccentric protrusion.

30. A printing system as defined in claim 1; and further comprising a blocking device having a plurality of teeth spaced from one another by teeth gaps; and a common pawl shaft, each of said pawls at a radial spacing from said common pawl shaft having a blocking tooth engageable with said toothed gap between two successive teeth of said blocking device of a respective one of said type wheels, each of said blocking teeth being formed for blockage in both directions of rotation.

31. A printing system as defined in claim 30, wherein said blocking device includes a blocking disc solidly connected with a respective one of said type wheels.

32. A printing system as defined in claim 30, wherein said teeth of said blocking device are formed in a side view substantially like teeth of a circular saw blade, said tooth gaps being approximately U-shaped, and a respective preceding tooth of said teeth in direction of revolution of said tooth gap having a tooth back dropping off obliquely towards said tooth gap.

33. A printing system as defined in claim 32, wherein said blocking tooth of said pawl has a portion engaging in said U-shaped tooth gap and on one side an oblique angle beginning at a base of said portion, with an edge coming to rest on said oblique tooth back.

34. A printing system as defined in claim 1; and further comprising a common pawl shaft, each of said pawls having three protruding arms extending at a radial spacing from said common pawl shaft, each of said arms being formed identically; and an armature engaging with an electromagnetic as an actuator and retained by said arms of said pawl.

35. A printing system as defined in claim 34, wherein said pawls include a first pawl which carries on its first arm and a first electromagnet associated with said first arm and said armature, a second pawl which on its second arm carries an armature and a second electromagnet associated with said second arm and said armature, a third pawl which on its third arm carries an armature and a third electromagnet associated with said third arm and said armature.

36. A printing system as defined in claim 35, wherein each of said armatures of a respective one of said arms of said pawl is retained in a yieldable fashion; and further comprising means for yieldably retaining each of said armature.

37. A printing system as defined in claim 36, wherein said means for retaining is formed as a resilient means.

38. A printing system as defined in claim 36, wherein said means for retaining is formed as a spring means.

39. A printing system as defined in claim 35, wherein each of said armatures is substantially U-shaped and has two legs fitting over a respective one of said arms of said pawl and a cross bar covering a narrow face of said arm and resiliently supported opposite said arm by a spring received in said arm.

40. A printing system as defined in claim 39; and further comprising a retaining bolt extending through an opening in each of said arms of said pawl so as to penetrate said two legs of said armature with radial play.

41. A printing system as defined in claim 35, wherein each of said armatures has a cross bar with an outer face facing toward a respective one of said electromagnets and provided with surface formations.

42. A printing system as defined in claim 41, wherein said surface formations are formed as formations selected from the group consisting of surface indentations, surface protuberances, longitudinal channels and transverse channels.

43. A printing system as defined in claim 1, wherein each of said type wheels is provided on its circumference with twelve said types disposed at equal circumferential angle spacings from one another.

44. A printing system as defined in claim 43, wherein ten of said types of each of said type wheels are formed as numbers from 0 to 9.

45. A printing system as defined in claim 44, wherein one type of each of said wheels is formed as a letter.

46. A printing system as defined in claim 45, wherein one type of each of said type wheels is formed as a space.

47. A printing system as defined in claim 46, wherein said letter type and said space are located between said number types 1 and 0.

48. A printing system as defined in claim 31, wherein said blocking disc has twelve teeth located one after the other with identical circumferential angles spacings.

49. A printing system as defined in claim 1, wherein said feeler device for each of said type wheel has three Hall sensors located intervals from one another along a path of revolution of said type wheel; and further comprising a plurality of individual permanent magnets of different polarity arranged so that each of said type wheels is associated with said individual permanent magnets of different polarity.

50. A printing system as defined in claim 49, wherein said permanent magnets are each located on a circumferential region between two of said types.

51. A printing system as defined in claim 49, wherein each type of each of said type wheels is identified by signals of two of said permanent magnets.

52. A printing system as defined in claim 49, wherein for coding said types of each of said type wheels, said permanent magnets are grouped in the order S S O N S O S N O N N O, where N is north pole, O is no permanent magnet, and S is south pole, beginning with the number "1" and following from there in direction of revolution of said type wheel.

53. A printing system as defined in claim 1, wherein said slip coupling of each of said type wheels has a friction disc which is positively connected to said common shaft and pressed against said type wheel by an axial pressure.

54. A printing system as defined in claim 53, wherein each of said friction discs has a plastic coated steel.

55. A printing system as defined in claim 53, wherein said common shaft has a groove, each of said friction discs having a radial driver formed as a dog which positively engages said groove of said shaft.

56. A printing system as defined in claim 1; and further comprising a carrier, said printing units being located in a circumferential direction at intervals from one another on said carrier, all of said printing units revolving in common, said disc being formed as a single stationary disc.

57. A printing system as defined in claim 56, wherein said carrier is formed as a drum on which said printing units are located.

58. A printing system as defined in claim 56; and further comprising a further common shaft formed so that said printing units are mounted on said further common shaft and driven to revolve by said further common shaft.

59. A printing system as defined in claim 1, wherein said printing units are arranged on an imaginary axial line extending parallel to an axis of revolution, said stationary disc acting as a drive mechanism and being associated with each of said printing units on an axial line.

* * * * *